US007827687B2

(12) United States Patent
Mansfield et al.

(10) Patent No.: US 7,827,687 B2
(45) Date of Patent: Nov. 9, 2010

(54) METHOD OF MODIFYING AN UPPER GEARSET OF A MARINE STERN DRIVE

(75) Inventors: Aaron C. Mansfield, Lake Havasu City, AZ (US); Jason A. Mansfield, Lake Havasu City, AZ (US)

(73) Assignee: Max Machine Worx, Inc., Lake Havasu City, AZ (US)

( * ) Notice: Subject to any disclaimer, the term of this patent is extended or adjusted under 35 U.S.C. 154(b) by 278 days.

(21) Appl. No.: 12/231,945

(22) Filed: Sep. 8, 2008

(65) Prior Publication Data

US 2009/0118023 A1 May 7, 2009

Related U.S. Application Data

(60) Division of application No. 10/948,940, filed on Sep. 24, 2004, now Pat. No. 7,422,500, which is a continuation-in-part of application No. 10/072,380, filed on Feb. 6, 2002, now abandoned, which is a continuation-in-part of application No. 09/678,154, filed on Oct. 2, 2000, now Pat. No. 6,491,588.

(51) Int. Cl.
*B21D 53/00* (2006.01)
*B23P 11/00* (2006.01)
*B63H 20/32* (2006.01)

(52) U.S. Cl. ..... 29/889.6; 29/525.01; 29/525.11; 440/78

(58) Field of Classification Search ..... 29/889.6, 29/434, 525.01, 525.11; 440/78
See application file for complete search history.

(56) References Cited

U.S. PATENT DOCUMENTS

| | | | | |
|---|---|---|---|---|
| 301,512 | A | | 7/1884 | Mixer |
| 924,039 | A | | 6/1909 | Clark |
| 1,186,325 | A | | 6/1916 | Metzger |
| 2,083,091 | A | | 6/1937 | Rector |
| 4,652,167 | A | * | 3/1987 | Garman ..... 403/158 |
| 4,702,724 | A | | 10/1987 | Vater |
| 5,052,959 | A | | 10/1991 | Mondek |
| 5,120,092 | A | | 6/1992 | Gorog et al. |
| 5,230,540 | A | | 7/1993 | Lewis et al. |
| 5,558,456 | A | | 9/1996 | Nakase et al. |
| 5,813,706 | A | | 9/1998 | Travis |
| 6,254,443 | B1 | | 7/2001 | Payne |
| 6,491,588 | B1 | | 12/2002 | Mansfield et al. |
| 7,422,500 | B1 | | 9/2008 | Mansfield et al. |

OTHER PUBLICATIONS

U.S. Appl. No. 10/072,380, filed Feb. 6, 2002.

MerCruiser Service Training Notebook, 90-90593, 8-1093, Brunswick Corporation, Nov. 1993, pp. 16, 41-43.

(Continued)

*Primary Examiner*—Jermie E Cozart
(74) *Attorney, Agent, or Firm*—Craig R. Miles; CR Miles, P.C.

(57) ABSTRACT

A support for the upper drive shaft of a marine stern drive unit. The support has an axial body installable in the axial bore of the upper case. Retainers on the body are engageable with the upper case to secure the support in place. One or both retainers are axially adjustable relative to the body. Adjustment may be achieved at threaded sections on the body which matingly engage threaded sections on the retainer.

20 Claims, 11 Drawing Sheets

OTHER PUBLICATIONS

Mercury MerCruiser #28 Service Manual, Bravo Sterndrive Units, Serial No. OM100000 and above, 90-863160, May 2000, three total pages.

Mercury MerCruiser #28 Service Manual Supplement, Bravo Sterndrive Units, 90-863160030, Nov. 2003, p. 3A-18, two total pages.

Workshop Manual, Aquamatic 270 Outboard Drive, Models B, C and D, Volvo Penta, 7724371-5, Nov. 1976, pp. 3, 13, 30-33.

MerCruiser Service Manual No. 11, Bravo Stern Drives, 90-17431-3 796, Jan. 1996, pp. 3A-12, 3A-13, 3A-29, 3A-31, 3A-37, 3A-43, 3A-46, 3C-2, 3C-3, 3D-4, and 3D-5.

Xtreme Advantage SC, Parts and Service Manual, IMCO, Jan. 2001, pp. 11, 13, 14, 18 and 19.

Bravo One XR & XZ, Sterndrive Unit Chart (Gasoline) Bravo (XR & XZ), 90-891749, printed date of Mar. 21, 2007, ten total pages.

OEM Factory Service Manual #28 Bravo Sterndrive Units, Part #90-863160; Section A Driveshaft; Section B Gear Housing; May 2000, Mercury Marine.

OEM Factory Service Manual #28 Supplement, Part #90-863160030; Nov. 2003.

OEM Factory Service Manual #11 Bravo Sterndrive, Part #90-17431-2 & 90-17431-3; Feb. 1994.

OEM Factory Service Training Notebook, Part #90-90593; Aug. 1993.

OEM Factory 2000 Model Year Mercrusier Recertification Program Textbook Manual Part #90-854002-00; Jan. 2000.

OEM Factory Service Manual #20 Blackhawk Sterndrive, pp. 3A-24 to 3A-25; Jul. 1992.

* cited by examiner 10
13
17
20
71
72
38
28
31
27
42
50
24
26
39
16
15
18
19
64
12
65
40/70
23
60
61
62
14
66
68
69
67

CUT A
REMOVES CAST ALUMINUM BEARING/ GEAR SUPPORT FOR CHROMOLY BEARING TOWER & CASE SUPPORT

CUT B
REMOVES .100-.200" IN DEPTH @ 3.20 DIA. FOR LOWER DISC. SECTION & SETSCREW IS DRILLED AND THREADED.

CUT C
60° CHAMFER CUT FOR PRECISE FIT.

CUT D
REMOVES TOP OF TAPER CASTING TO 1.580"-1.65" TO ACCEPT CHROMOLY TOWER SHIM/SLEEVE INSERT THROUGH UPPER CASE FOR ADDITIONAL SUPPORT.

METHOD OF MODIFYING AN UPPER GEARSET OF A MARINE STERN DRIVE

This U.S. patent application is a continuation of U.S. patent application Ser. No. 10/948,940, filed Sep. 24, 2004, now U.S. Pat No. 7,422,500, issued Sep. 9, 2008, which was a continuation-in-part of U.S. Non-Provisional Patent Application Ser. No. 10/072,380, filed Feb. 6, 2002, abandoned, which was a continuation-in-part of U.S. Non-Provisional Patent Application No. 09/678,154, filed Oct. 2, 2000 now U.S. Pat. No. 6,491,588, issued Dec. 10, 2002, each hereby incorporated by reference.

FIELD OF THE INVENTION

The present invention relates to a power transmission system and more particularly relates to a support in the upper case housing of a marine stern drive unit which supports the upper gearset and vertical drive shaft to enable the stern drive unit to transmit increased torque and horsepower.

BACKGROUND OF THE INVENTION

Stem drives for boats are well known and are popular among boat enthusiasts and the marine work force as well. Typical of these are units such as the Bravo 1, 2, 3, X, XZ and XR manufactured by Mercury Marine (Brunswick Corporation). Conventional stern drive units consist of an upper gear case housing which mounts on the transom of a boat for pivotal movement about a generally vertical steering axis. The stern drive unit also pivots about a generally horizontal pivot axis so the unit may be lifted or trimmed out of the water for inspection and trailering. The engine is normally mounted at the rear of the boat adjacent the transom. A shaft extends from the engine coupler through a gimbal bearing mounted in the transom assembly and connects to a U-joint which, in turn, connects to the input yoke shaft. The input shaft is connected to the pinion gear of the upper unit. The upper pinion gear, in turn, selectively drives the forward and reverse driven gears on the upper gearset. A clutch and spring assembly are stationary with the shift fork assembly centered around the clutch. The upper drive shaft extends through the center of both the forward and reverse driven gears. The clutch and spring are part of a gear, clutch, spring, and shaft assembly.

When the shift fork is moved by the shift cable, the clutch spins up or down on spiral splines on the shaft and engages a cup on top of the driven gear, which, in turn, engages the upper vertical drive shaft located in the upper case housing and which connects to lower gear case vertical shaft.

The lower gear case vertical shaft is supported by roller or needle bearings with race cups, a tab washer, pre-load shims, a pre-load spacer and O-ring above the bearings. Pinion gear height adjustment shims are located beneath the bearings. At the bottom of the lower case is the lower pinion gear. Power is transferred to the lower driven gear which, in turn, is splined to the horizontal propeller shaft which is supported by a bearing carrier that is held by a carrier nut. The propellor slides on the spline of the propellor shaft aft end and is held in place by the propnut and washer.

A significant problem with stern drive units of the general type described above is that the transmission provided by the original equipment manufacturers (OEM) of such units are limited in their power transfer capacity. If the boat owner wishes to modify or replace the marine engine increasing its torque, performance and horsepower, the transmission (upper gear, clutch, spring, bearing and shaft assembly) may be incapable of transmitting the increased horsepower and torque from the engine to the propeller shaft and propeller without damage to the transmission or the upper gear case housing support structure. Often the damage occurs to the transmission components such as fracturing of the upper gear case housing structure support. Another common problem is gear backlash due to the upper gear case housing flexing from increased torque, horsepower, heat growth factors and increased shock load and RPM. Such failures can be very expensive to repair requiring substantial replacement of the stern drive unit components, particularly the upper gear case housing and transmission assembly.

In view of the foregoing, there exists a substantial need for an improved stern drive unit which will accommodate increased engine power, torque and performance, and which can be provided both as an OEM boat builder option or an after-market unit.

BRIEF SUMMARY OF THE INVENTION

Briefly, the present invention provides a support for the drive shaft and upper gearset of a marine stern drive unit. The support includes a generally axially extending tubular body member which is threaded at least at one end to receive a first threaded retainer. A second threaded retainer is provided on the body spaced from the first threaded retainer. The second retainer may be fixed or threaded. The tubular member has an upper gearset mount at its upper end which may be a bearing cup or a conical bore which extends partway into the vertical bore in the support. Bearings, such as roller bearing, needle bearings, tapered roller bearings or 4-angle contact ball bearings are pressed, or otherwise secured, at the upper end of the tubular member. The support is installed into a stern drive unit by removing the top cover to provide access to the vertical shaft. The vertical drive shaft is removed and the support is inserted from the top. Some modification of the upper case may be necessary. The support is secured by tightening one or both of the retainers bringing them into clamping engagement with the surfaces of the case. The threaded retainers may be a spanner nut on the lower end of the support or may be an upper retainer threaded to the upper end of the support.

A flange or floor extends from near the upper end of the support body. The support is further secured by inserting a fastener, such as a set screw, through a bore in the floor with the set screw engaging a component or structure of the upper drive shaft housing. The drive shaft and other components such as the U-joint assembly, top cover and the like can then be installed completing the installation. The upper gearset mounts on the upper end of the support and is coupled to the upper shaft which carries the clutch and gearing. Mounting the gearset on the support will increase the capacity of the drive by a factor of up to three. Preferably the support is fabricated from a high quality aerospace alloy such as 300 m for much greater shock loads, but can be manufactured from 4140 or 4130 chrome moly steel or stainless steel.

The method involves removing the existing components, modifying the case as required and installing the support, drive shaft, clutch, gearset, bearings and other components. The support when installed is retained in engagement with the casing and extends substantially the length of the upper case housing.

BRIEF DESCRIPTION OF THE DRAWINGS

The above and other objects of the present invention will be better understood from the following description and claims in which:

DETAILED DESCRIPTION OF THE INVENTION

Figure 1:
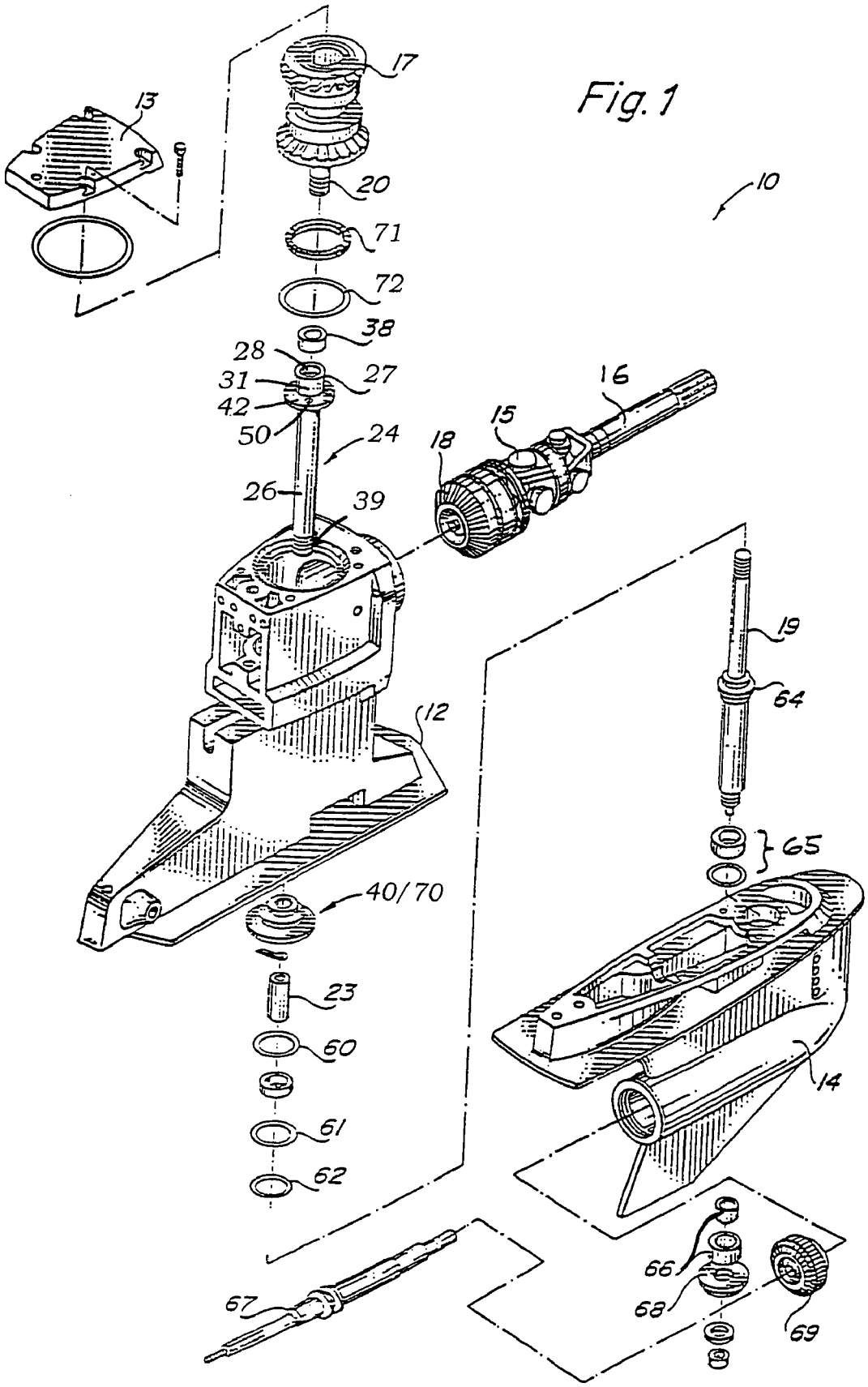
FIG. 1 is an exploded view showing the basic components of a stern drive unit and the installed position of the upper gearset support of the present invention.
Figure 2:
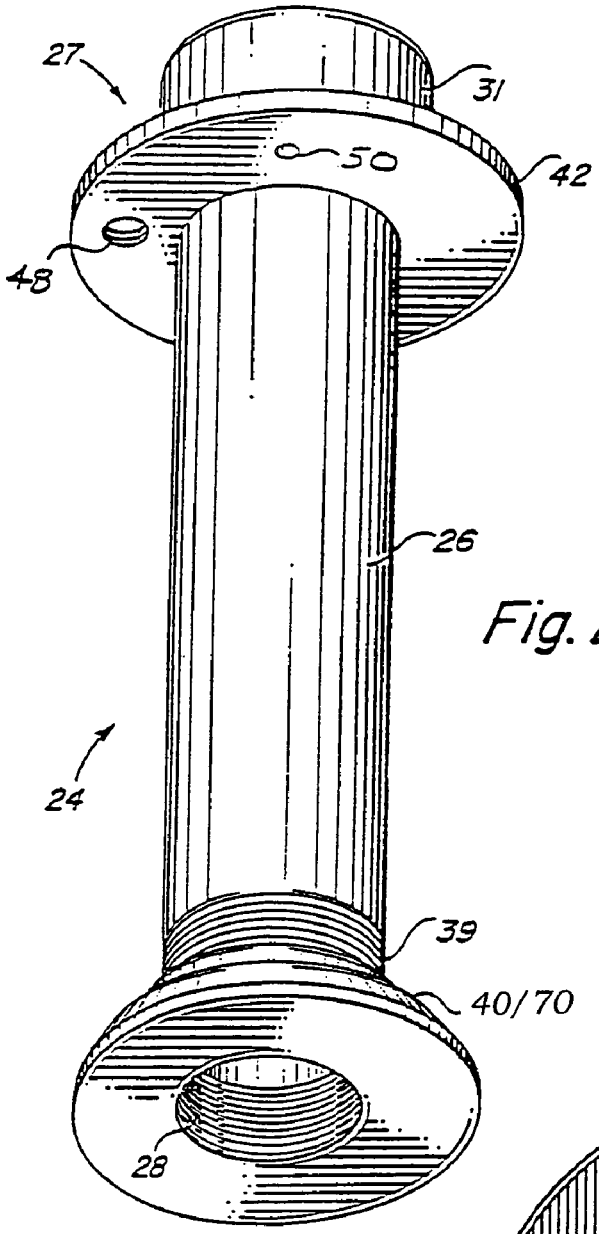
FIG. 2 is a perspective view of the upper gearset support of the present invention.
Figure 2A:
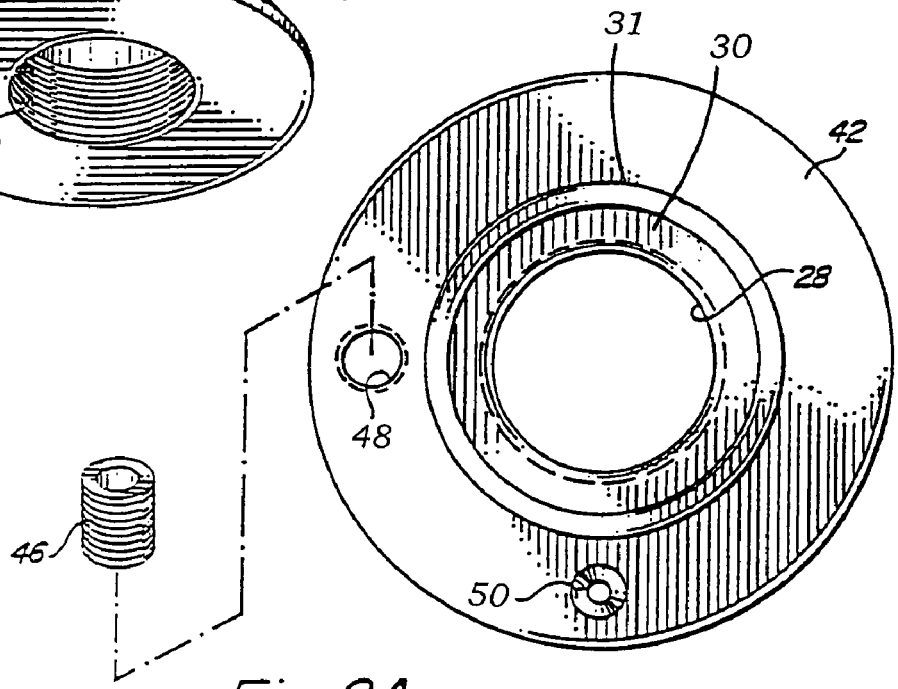
FIG. 2A is a top view of the support of FIG. 2.

Turning now to the drawings, a stern drive unit 10 is shown in FIG. 1. The stern drive unit 10 is representative of the Bravo stern drive units manufactured by Mercury Marine. Stern drive units 10 of this type have an upper gear housing 12 which is adapted to be mounted on the transom of a boat at a bracket, not shown. Access is provided by cover plate 13. The upper gear housing 12 along with the lower gear housing 14 are pivotal about a generally vertical axis in order to steer the craft. The stern drive unit is also vertically pivotal so that it may be tilted to a position out of the water when not in use or for trailering, service or inspection.

A U-joint assembly 15 has a shaft 16 which is coupled to an engine within the boat, not shown. The outer end of the U-joint assembly is provided with a straight tooth gear 18 and which, through a clutch and gear set assembly 17 and upper shaft 20, imparts rotation to vertically extending drive shaft 19. The drive shaft 19, when installed, is coupled to an upper drive shaft 20 by a coupler 23 which is driven by the shaft 20. The drive shaft assembly includes a retainer 40, O-ring 60, pre-load shim 61, washer 62, bearing and race assembly 64 and lower shim 65.

The lower end of the drive shaft 19 is received within the lower gear housing 14 which, as mentioned above, is affixed to the upper gear housing for common movement therewith. A propeller shaft 67 is driven by a lower pinion drive gear 68 and pinion 69 carried on splines on the propeller shaft. The outer end of the propeller shaft carries a propeller with the propeller shaft being rotatably driven by a gear on the lower end of the vertical drive shaft which engage a gearset on the propeller shaft.

The vertical drive shaft is held in place by bearings 66 located in the lower gear housing, such as tapered roller bearings and races. The above installation and environmental description of a stern drive unit is provided to assist in the understanding of the present invention.

As indicated above, the conventional stern drive transmission is adequate in many instances but is insufficient for applications in which the marine engine is a high performance engine. Accordingly, the present invention provides a support for the vertical shaft 19 and the upper clutch and gearset assembly 17 which support can be readily positioned within the upper drive shaft housing and which will support the upper gear and clutch assembly to allow the stern drive to transmit greater horsepower and torque to the propellor due to the reduction of radial and axial gear and gear case movement.

Figure 3:
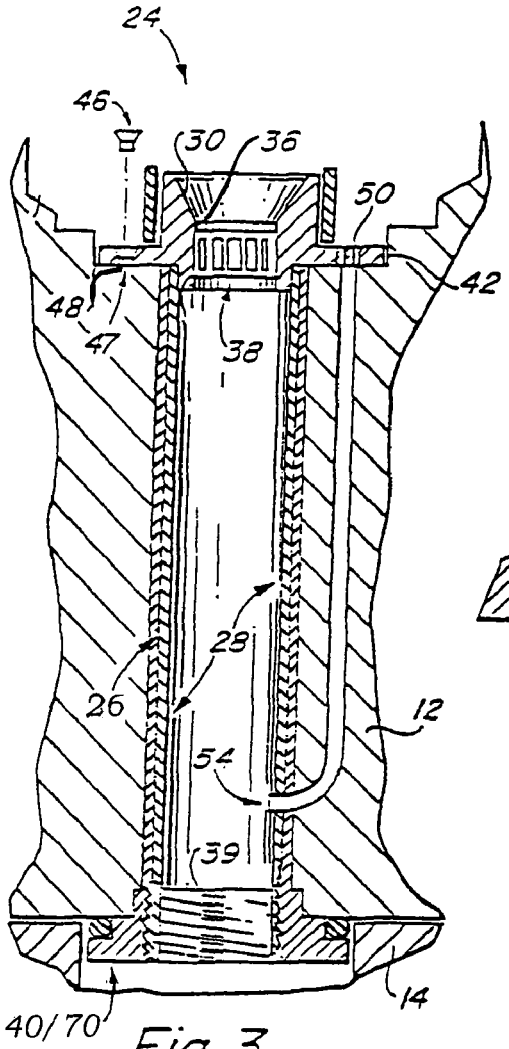
FIG. 3 is a cross-sectional view showing the support installed in the upper case.
Figure 4:
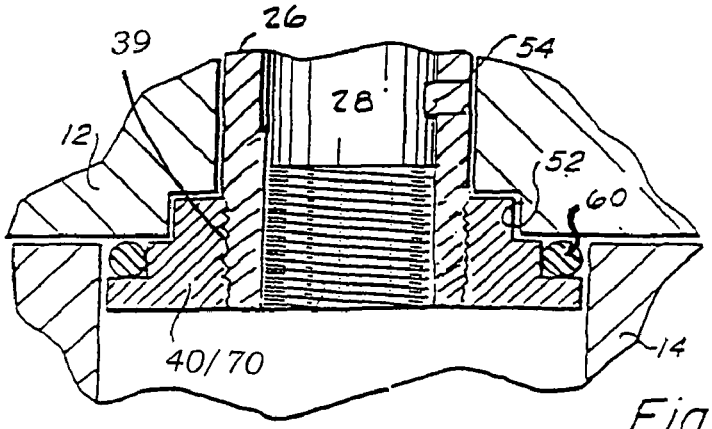
FIG. 4 is a detail view of the lower end of the support.

Turning to FIGS. 2 to 5, the gear and shaft support 24 of the invention has an axial body 26 which defines an axially extending bore 28. The length and inner and outer diameters body are selected in accordance with the physical dimensions of the drive unit in which the support is to be installed. Typically for installation in drive units such as a Bravo 1, 2 or 3, manufactured by Brunswick Corporation, the outer diameter of the body will be 1.450" to 1.800" and the overall length 10.250"-10.750". The length is sufficient so the lower end of the body will depend into the lower case as seen in FIG. 4.

The upper end 27 of the body is machined on its O.D. at 31 to accept a ball bearing or a caged needle bearing race on the bottom gear of the upper gear and clutch assembly therefore providing support for both the upper gearset and clutch assembly and the upper drive shaft assembly.

As best seen in FIG. 3, the upper end 27 of the body 26 is also provided with an internal conical tapered section 30 which extends to a shoulder 36. A bearing assembly 38, such as ball bearings, or as shown, needle bearings or caged needle bearings, are pressed into the area below the shoulder to receive and support the outer diameter of the upper drive shaft 20.

Figure 5:
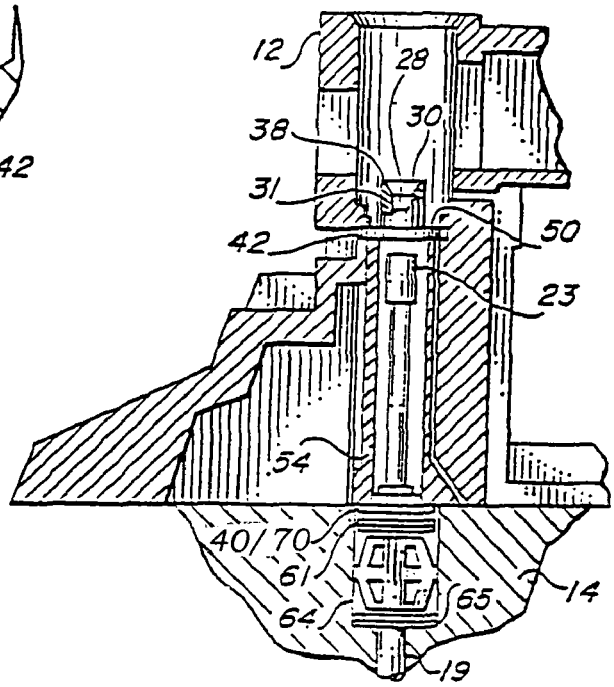
FIG. 5 is a cut-away view showing the support installed in the upper housing and also showing the support extending below the mating surface of the upper housing into the lower housing in an assembled position.

The lower end of the axially extending body 26 is provided with external threads 39. A retainer shown as spanner nut 40 is threaded and is engageable with the threads 39 so that when the support is inserted into position in the upper housing, as shown in FIGS. 3, 4 and 5, it is secured at its lower end by engaging the retainer 40 about the threads 39 and tightening it until the retainer engages the internal structure of the case, such as the stepped surface 52 of the upper drive housing as seen in detail in FIG. 4. It will be noted that lateral motion is resisted by the engagement of the periphery of the retainer 40 in the lower case 14. An O-ring seal 60 is also installed. The lower end of shaft 19 is connected to the lower pinion gear 68. The lower pinion gear drives gear 69 on the propeller shaft 67.

A circular flange or floor 42 is spaced from the upper end of the body and is located to seat on a surface 47 of the upper drive shaft housing as shown in FIG. 3. The support is secured against rotation by means of a retainer, such as set screw 46, which extends within a bore 48 in the flange 42. The set screw will engage surface 47 of the upper case structure. An additional bore 50 may be provided in the flange 42 which may serve as a lubrication transfer port. Additional oil ports 54 may also be provided at locations along the body.

Once in position, the re-assembly is completed by installing the upper gear and clutch assembly 17 onto the support, connecting the U-joint assembly to the drive shaft via the upper shaft and replacing other components including the cover unit. When installed, the upper gear and clutch assembly will allow use of higher performance or higher rated marine engines.

Figure 9:
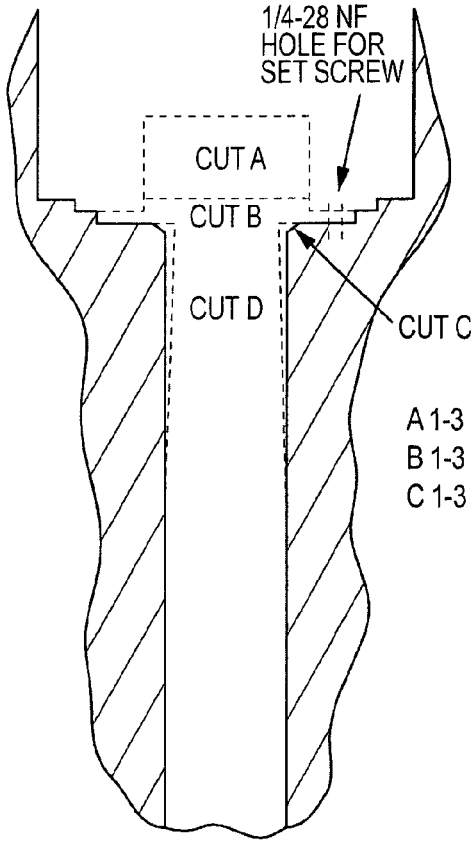
FIG. 9 illustrates the machining modifications that may be necessary to install the support in an existing stern drive unit.

Normally some minor modification of the upper housing is required which involves machining away some sections of the housing casting to accommodate the support. FIG. 9 illustrates machining cuts A, B, C and D which are represented and are necessary to install the support in a unit such as the Bravo stern drive. The installation should require, but is not limited to, three cuts to the surrounding upper case housing. The unit is secured by the upper spline and the lower spanner which cooperate with existing structure within the upper gearset housing and lower gear housing pre-load requirement. The precise dimensions will depend on the unit and the installation will be apparent to those skilled in the art.

As mentioned above, the gear support housing can be an original equipment item installed by the factory or a retrofit item. The particular dimensions will be selected in accordance with the physical dimensions of the marine engine in which the support is to be installed. The retrofit or aftermarket installation also is a relatively simple procedure which requires removal of the cover of the upper gear and clutch assembly. Disassembly also includes removal of the drive shaft and U-joint assembly. Thereafter, the upper gear and clutch assembly support 24 can be installed in the upper drive shaft housing as described above.

Multiple tests on a stern drive unit, such as a Bravo, have demonstrated the effectiveness of the support. The conventional factory unit will accommodate up to approximately 400 horsepower. The factory unit was modified by removing the existing components and installing a support unit of the type described above:

EXAMPLE

The embodiment of the support is had an O.D. of 1.50", a main body with an overall length of 10.500", having a conical taper at the top of a bore which was 1.250". The bore was stepped to an I.D. of 1.315", approximately 1.75" from the top of the support. A flange having an O.D. of 3.210" was located 9.0" from the bottom of the support. The flange rested on a machined surface, as seen in FIG. 9. The flange 42 was 0.102" thick. The remaining 1.200" above the flange measured 1.800". The O.D. accepted a bearing race that supports the gearset. These measurements are matched to cuts A-D in FIG. 9 and fit Bravo 1, 2, 3, X, XR, XZ stern drives replacing cast aluminum with steel or steel alloy.

The resulting modification increased the capacity of the drive permitting the engine horsepower to be increased by as much as 650 horsepower at a cost substantially less than an equivalent larger capacity drive unit.

Figure 6:
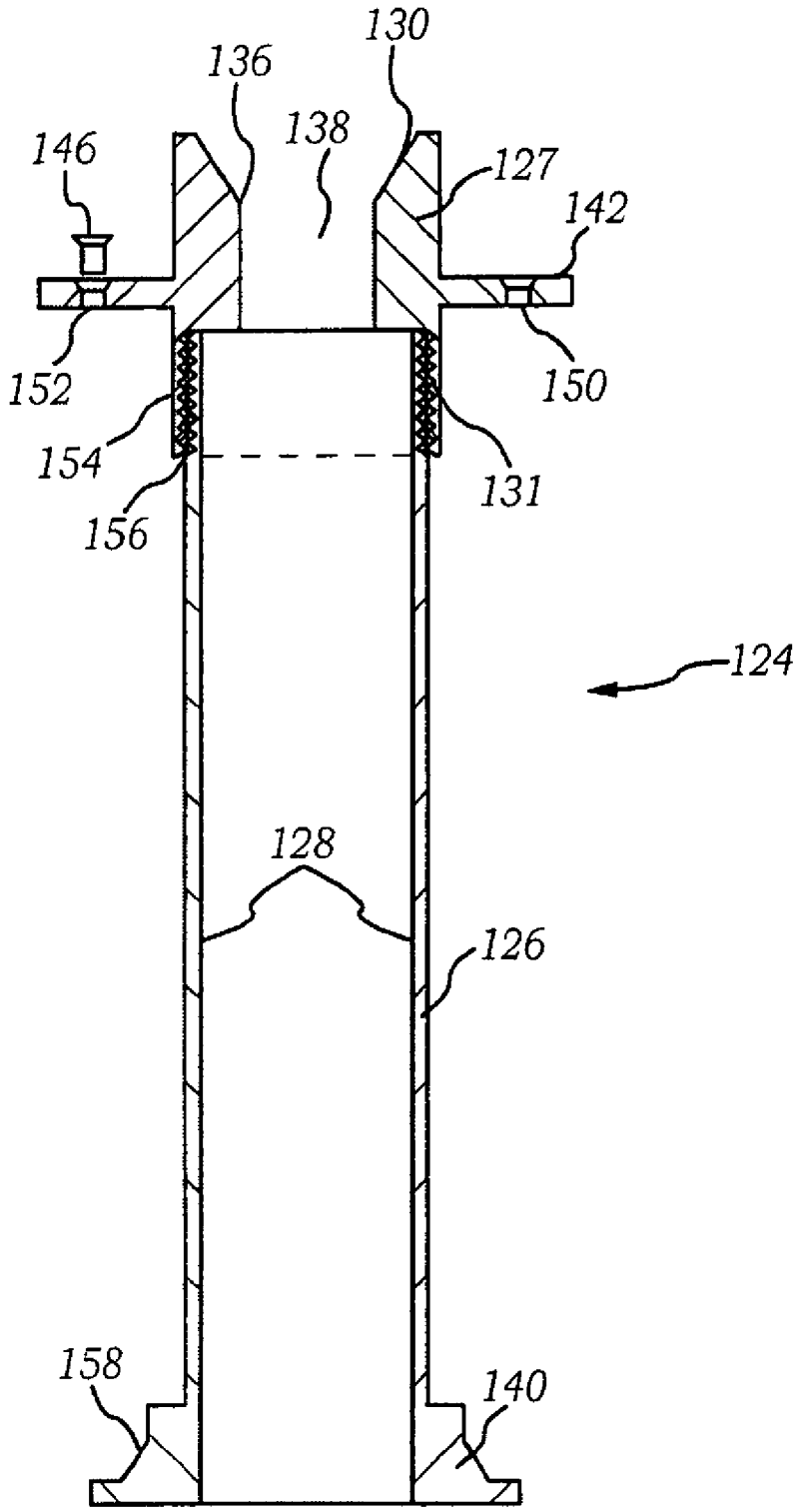
FIG. 6 is a perspective view of an alternate embodiment of the support of the present invention.

Turning now to FIG. 6, an alternate embodiment of the support is shown and designated 124. The support has a tubular body 126 defining a bore 128 extending from the upper end 131 to the bottom end. The upper end cap 127 has a conical taper 130 extending to shoulder 136. When installed, bearings 138 are mounted within the bore spaced below the shoulder.

The upper end cap carries a circular floor or flange 142 which has a bore 152 for receiving a set screw 146. Additional lubrication ports 150 may be provided in the floor. The floor is secured to structure within the upper case by the set screw.

The upper end of the body is externally threaded at 156. The upper end cap 127 has a cylindrical section which is internally threaded at 154 so the cap may be threaded on the tubular body 126. The lower end of the tubular body carries a retainer 140 having an exterior surface 158 contoured to engage a surface of the upper case housing, as seen in FIG. 4, with the exception that with embodiment 124 the retainer 140 is fixed.

The support is installed from the bottom of the upper case housing and the upper cap 127 screwed in place until floor 142 is tightly engaged in the upper case. Set screw 146 is then inserted in threaded bore 152.

Figure 7:
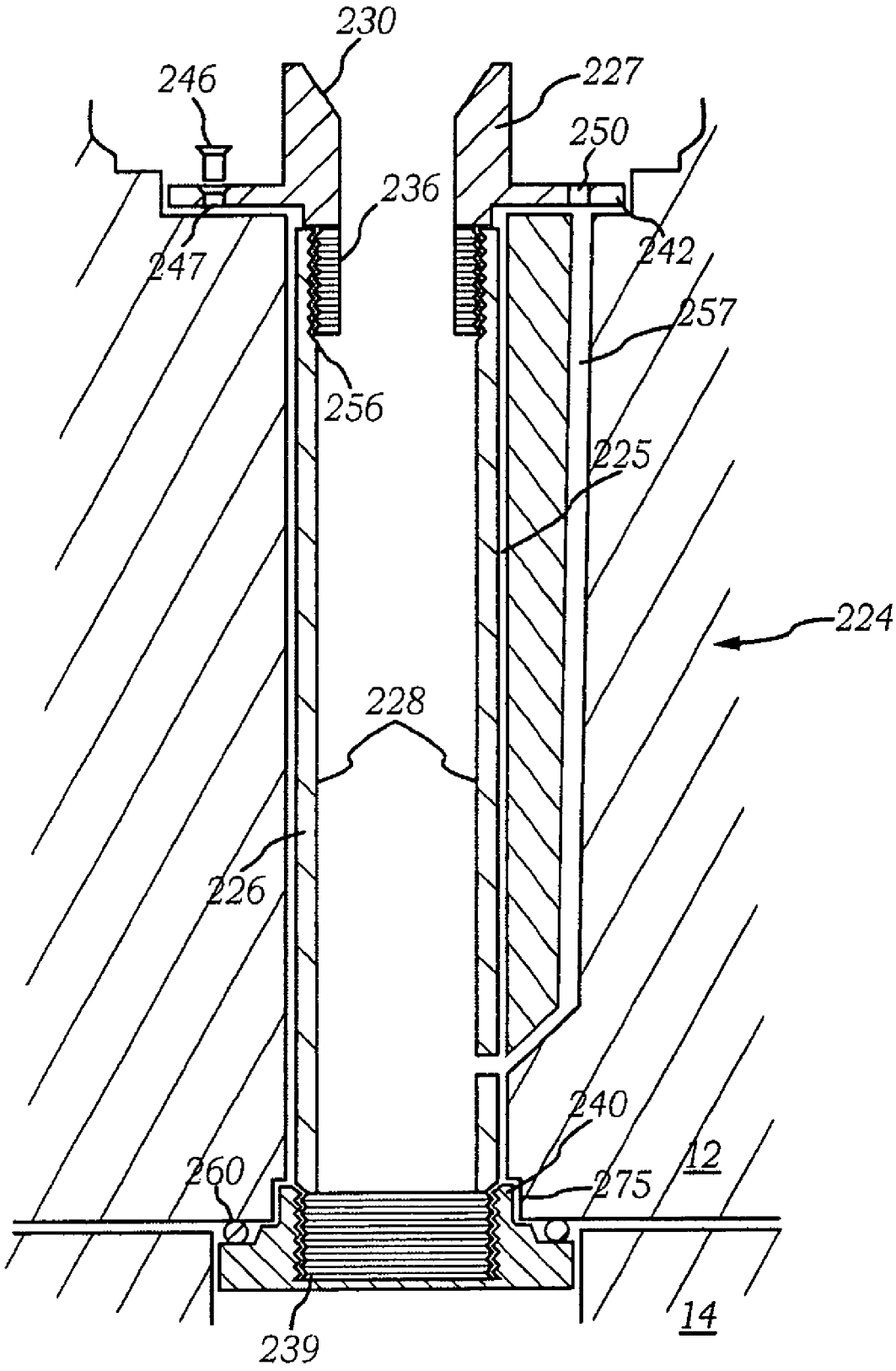
FIG. 7 is a cross-sectional view of yet another embodiment of the support.

In FIG. 7, another embodiment of the support of the present invention is shown and is designated by the numeral 224. In this embodiment, the support 224 has a body 226 having an axial bore 228 and an outer diameter 225. The upper end cap 227 has a threaded section 236 which engages the threads 256 located at the upper end of the bore 228. The upper end cap 227 carries annular floor 242 which defines a threaded bore 247 for receiving a set screw 246. The upper end of the cap 227 defines a conical surface 230 configured to receive a bearing assembly in the assembled position. Oil port 250 in floor 242 communicates lubricant to a location within the case along passage 257. Thus, the upper end cap 227 provides a bearing seat and also serves as an adjustable retainer for securing the support to the upper case 12.

The lower end of the body 226 is externally threaded at 239. The surface of the lower retainer 240 conforms to the configuration of the upper case 12 at the bottom of the bore 275. O-ring 260 seals between the upper and lower case. The retainer has threads allowing the retainer to be axially adjusted along the body. Thus, the support can be secured in the upper case by selectively adjusting the axial position of either or both retainers 227 and 240.

Figure 8:
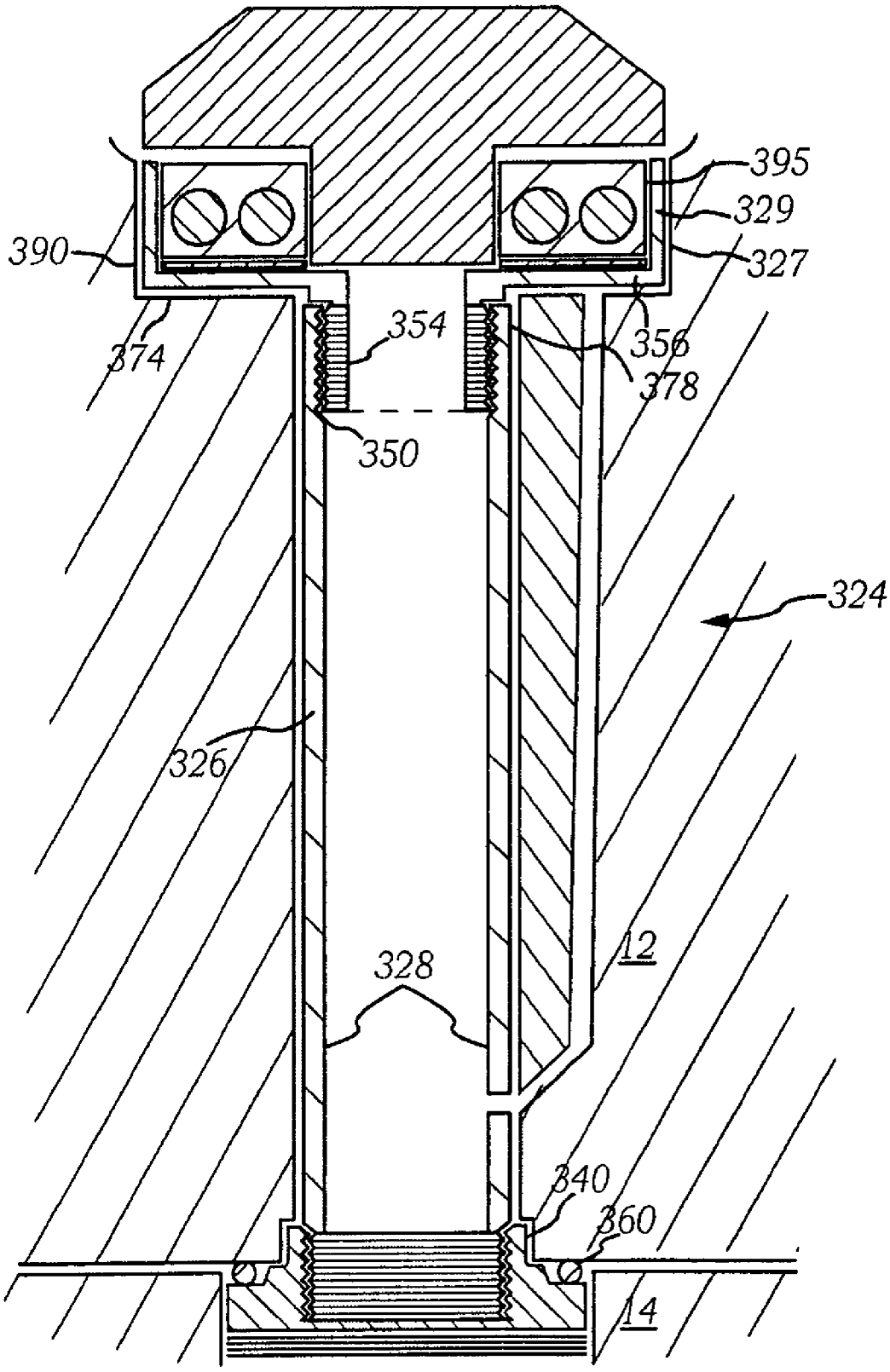
FIG. 8 is a cross-sectional view of another embodiment in which the upper bearings are retained in a bearing cup and the lower retainer is threaded on the support.
Figure 10:
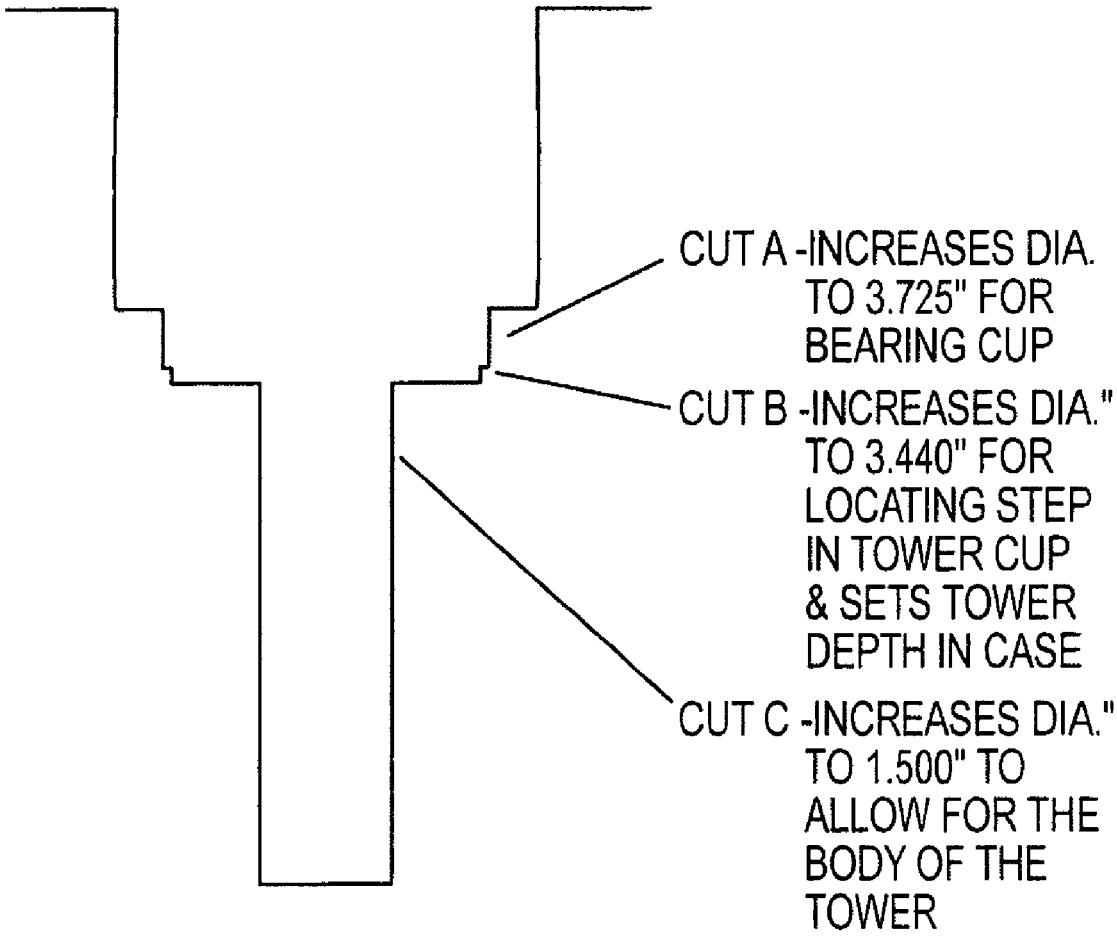
FIG. 10 illustrates the machining modifications that may be necessary to install the alternate embodiment of FIG. 8 in an existing stern drive unit.

In FIG. 8, an alternate embodiment of the support of the present invention designated by the numeral 324 is shown. In the embodiment of FIG. 8, the support 324 has a body 326 defining a shaft bearing bore 328. The support is received in upper case 12 in bore 356 which is machined to form an enlarged upper end bearing cap seat 390. This area is machined for bearings such as a tapered roller or ball bearing and also serves to secure the support 324 from lateral movement via the outside diameter. FIG. 10 illustrates the machining operations necessary to accommodate the support of FIG. 8.

The support has a retainer 340 at the lower end of the body which is configured to engage the corresponding surface of the case 12 sealed at O-ring 360 and is threaded at 341.

The upper end of bore 328 is threaded at 357. A bearing cup 327 has a generally circular wall 329 which receives bearing and race assembly 395.

The bearing cup 327 has a floor 330 and a depending cylindrical flange 378 which is externally threaded at 354 to mate with threads 357 in the upper end of the bore. The support 324 is installed with the lower retainer 340 positioned as shown engaging the lower end of the upper case. The bearing cup 327 is threaded into the bore and tightened until the support is securely held by the lower, retainer 340 which is threaded at 341, is screwed to external threads 343 and the floor 330 of the bearing cup abutting recess surface 376.

Figure 8A:
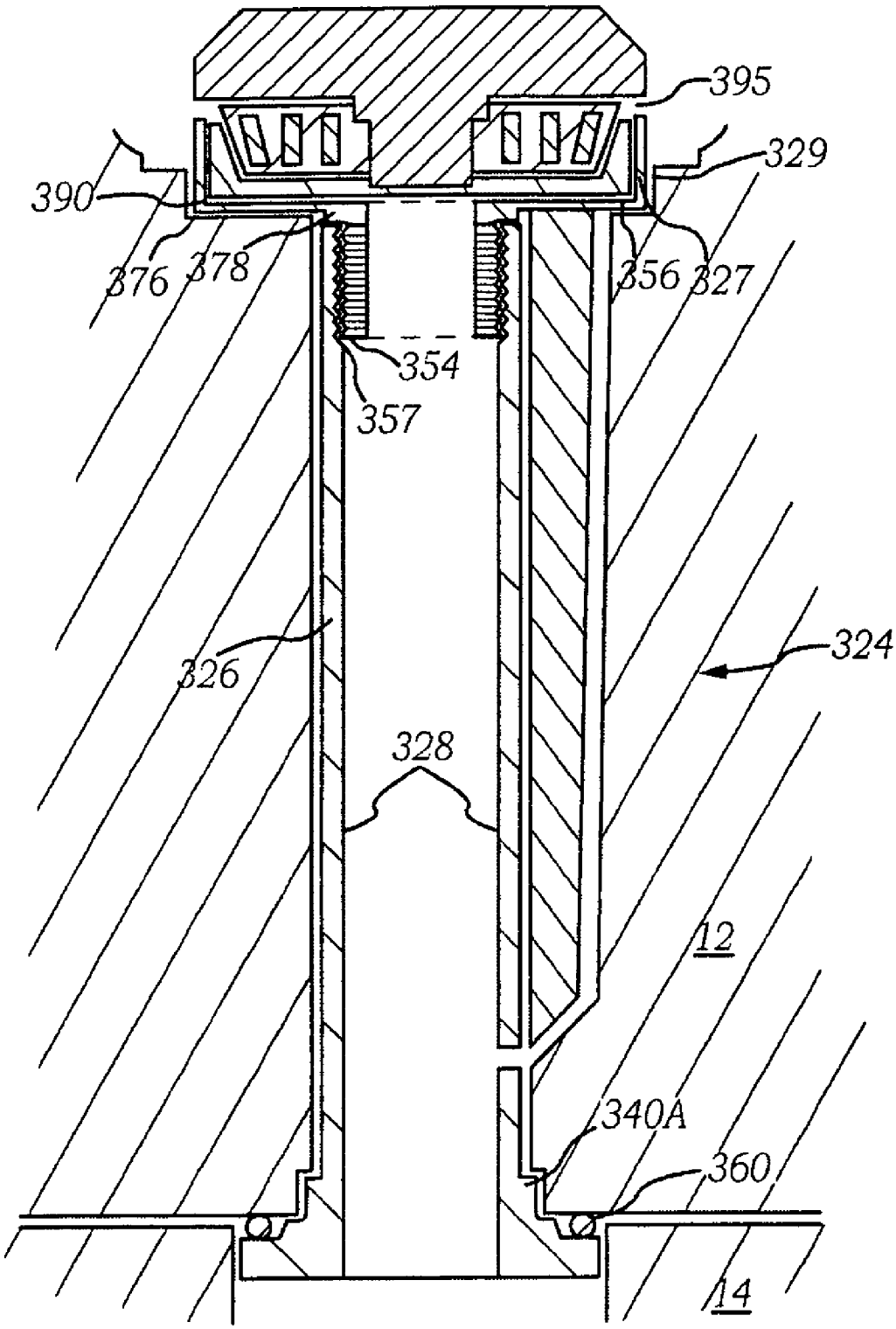
FIG. 8A is similar to FIG. 8 showing a fixed lower retainer and an axially adjustable upper retainer.

FIG. 8A shows a variation of the embodiment of FIG. 8 and the same elements as described with reference to FIG. 8 are used to identify the same or similar components. The variation shown in FIG. 8A has a fixed lower retainer 340A which engages the lower end of the upper case. Adjustment is achieved by tightening the upper bearing cup 327 into engagement with surface 376.

Figure 8B:
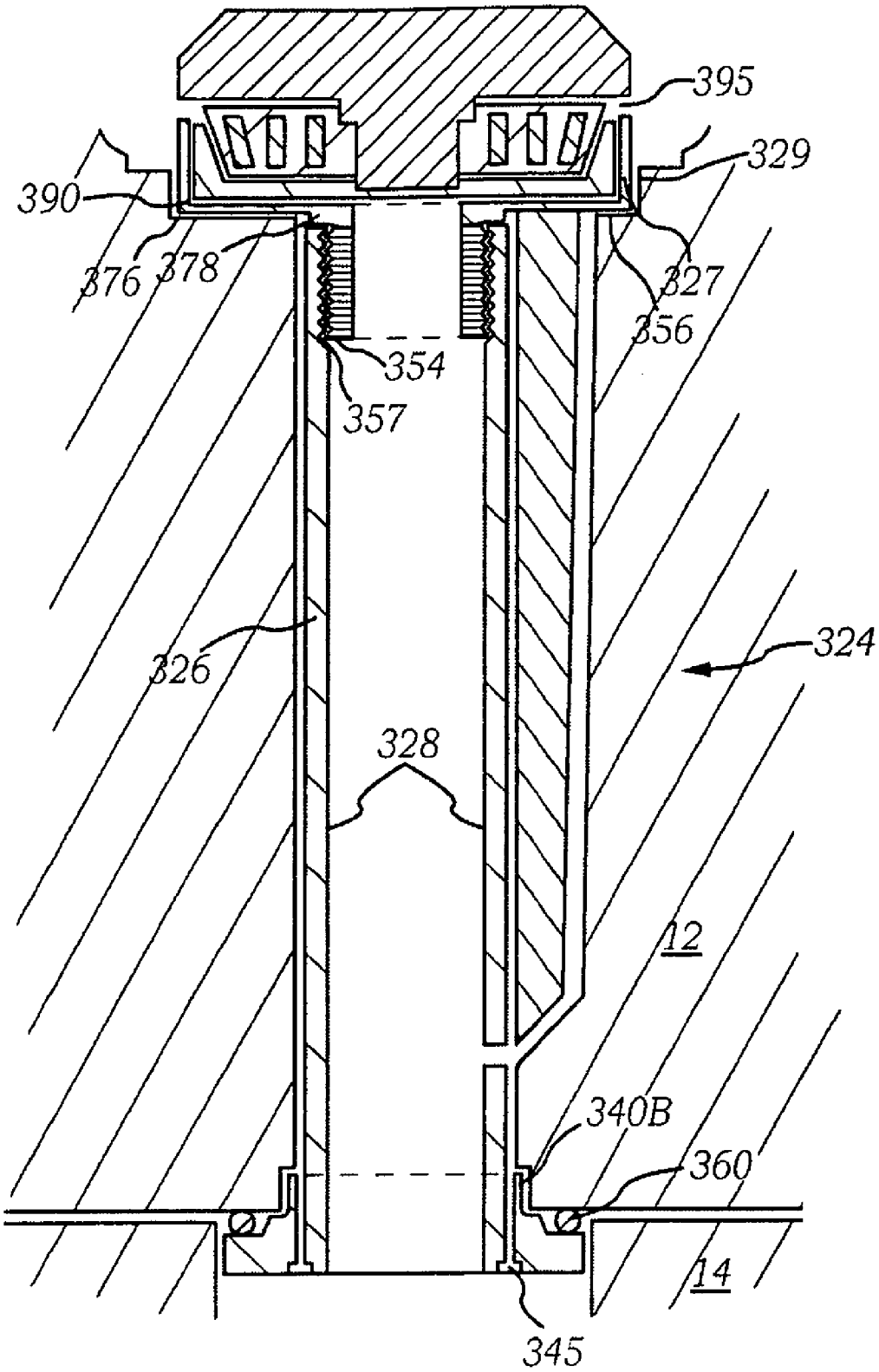
FIG. 8B illustrates a cross-sectional view of another embodiment of the support in which the lower retainer is pressed in an interference fit onto the lower body portion of the support and welded flush with the outer edge of the groove.

FIG. 8B shows a variation of the embodiment of FIG. 8 in which the same numerals, as described with reference to FIG. 8, are used to identify the same or similar components. The variation shown in FIG. 8B has a lower retainer 340B, which is press or interference fit onto the lower end of the support body 326 until the retainer 340B and the lower edge of the body 326 are flush. Once the support and retainer are located correctly, the retainer is welded 345 to the support body lower end thereby securing the support in the upper housing 12.

Figure 8C:
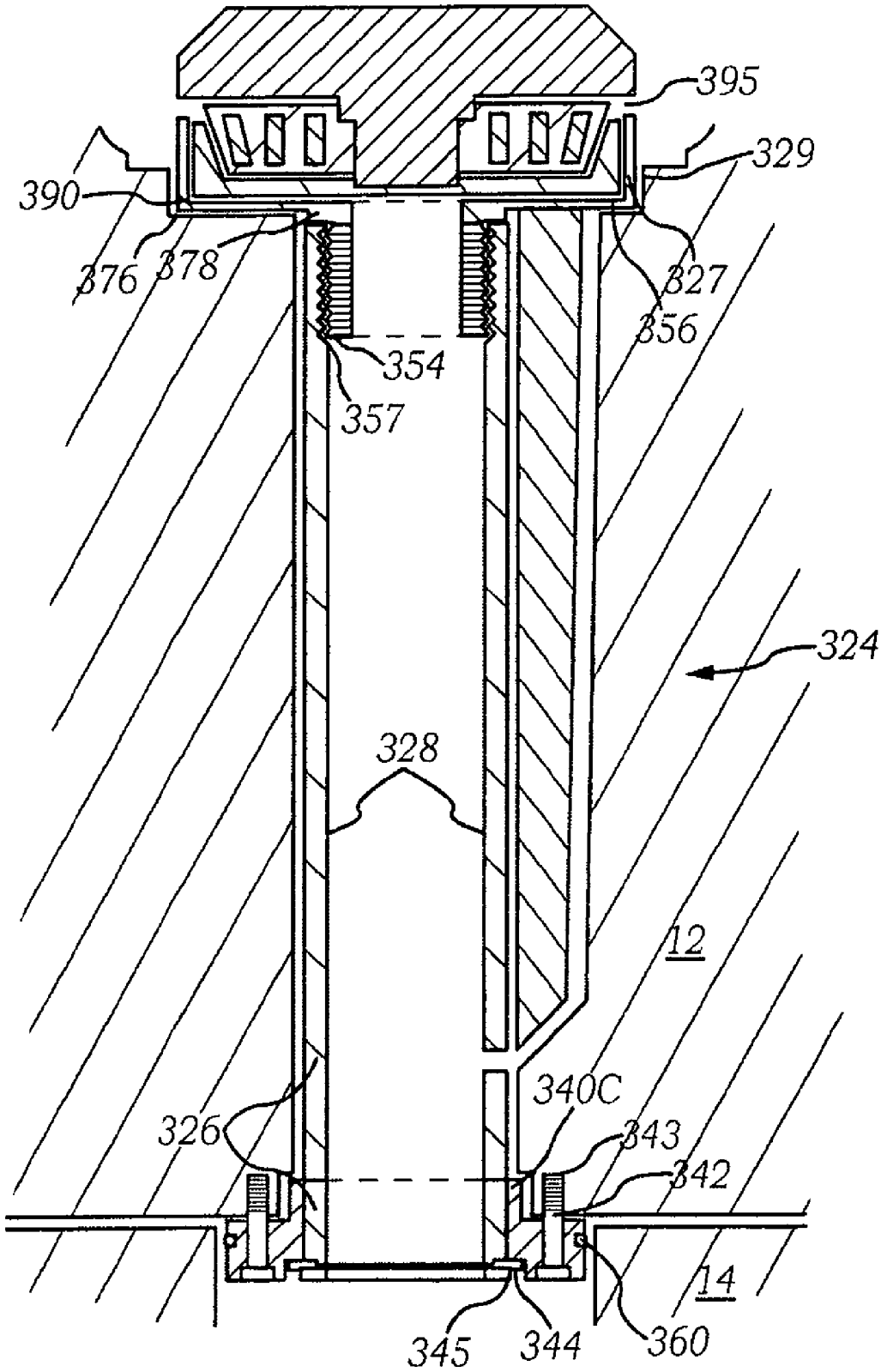
FIG. 8C illustrates a cross-sectional view of another embodiment of the support in which the lower retainer is secured by fasteners, set screws, bolts, set pins in combination such as with a spiral lock ring or snap ring or in an interference or press fit with the support body.

FIG. 8C shows another variation of the embodiment of FIG. 8 in which the same numerals, as described with reference to FIG. 8, are used to identify the same or similar components. The variation shown in FIG. 8C has a lower retainer 340C, which is press or interference fit onto the lower end of the support body, flush to the lower end of the support body. The retainer 340C receives set screws or set pins 342 are engaged into the set screw or set pin bores 343 securing the lower retainer in position in the upper housing 12. The lower retainer spiral lock ring or snap ring 344 is then installed in the support body lower ring groove 345 thereby securing the support body 26 to the lower retainer 340C.

While the invention has been described with reference to modification or retrofitting in existing stern drive units, it will be appreciated that the support may be incorporated s original equipment in a new manufactured unit.

While various materials may be used to fabricate the retainers, spacers and support body, the following list sets forth currently acceptable materials:

Improved-Machining Alloy Steels such as, but not limited to 4140; 4150; 4340; 6150; 8620c, such as Chromoly Steel.

Aircraft Quality Alloy Steels such as, but not limited to E4130 (MIL-S-6758); E4320H (AMS 6299); E4340 (MIL-S 5000); materials subject to magnetic particle inspection after the machining process, Nitralloy Aircraft Quality Alloy such as, but not limited to Nitralloy 135.

VAR (Vacuum Arc Remelt) Alloy Steels such as, but not limited to 300M (AMS 6417, 6419, MILS 8844); 9310VAR (AMS 6265, 6267, MILS 38030) conforming to AMS 2300 specifications.

Aluminum Alloys, 6061-T6, 7075-T7.

Stainless Steel Alloys, 200 Series; 300 Series; 400 Series, 17-4, 15-5.

It will be obvious to those skilled in the art to make various changes, alterations and modifications to the invention described herein. To the extent such changes, alterations and modifications do not depart from the spirit and scope of the appended claims. They are intended to be encompassed therein.

We claim:

1. A method of modifying a marine stern drive unit, comprising the steps of:

a) providing a support having a body which defines a shaft bore, said body having a length disposed between an upper end and a lower end;

b) providing a first retainer and a second retainer spaced a distance apart on said body, wherein at least one of said first retainer or said second retainer axially adjusts in relation to said body;

c) inserting said body in a shaft receiving bore defined by an upper case and a lower case of said marine stern drive unit; and d) axially adjusting at least one of said first retainer or said second retainer to engage said upper case with said support extending substantially the length of said shaft receiving bore.

2. The method of claim 1, further comprising the step of configuring said first retainer as a flange which extends radially outward from said body of said support.

3. The method of claim 2, further comprising the step of configuring said second retainer as a flange which extends radially outward from said body of said support.

4. The method of claim 3, further comprising the step of fixing location of said second retainer proximate said lower end of said body and adjusting relation of said first retainer to said body proximate said upper end by engagement of threads.

5. The method of claim 2, further comprising the step of fixing location of said first retainer proximate said upper end of said body and adjusting relation of said second retainer to said body proximate said lower end by engagement of threads.

6. The method of claim 2, further comprising the step of adapting said upper end of said body to fit a bearing for receiving an upper gearset.

7. The method of claim 6, wherein said step of adapting said upper end of said body to fit a bearing for receiving said upper gearset further comprises the step of adjusting the outer dimension of said upper end of said body to receive a bearing which engages a part of the surface of said first retainer.

8. The method of claim 7, further comprises the step of adjusting the inner dimension of said shaft receiving bore of said body to receive a bearing which engages a part of an upper drive shaft of said upper gearset.

9. The method of claim 8, further comprising the step of inserting said drive shaft into said shaft bore of said body of said support.

10. The method of claim 9, further including the step of installing an upper gearset at the upper end of said drive shaft.

11. The method of claim 6, wherein said step of adapting said upper end of said body to fit a bearing for receiving said upper gearset further comprises the step of configuring said flange of said first retainer to further provide a bearing cup.

12. The method of claim 11, further comprises the step of adjusting the inner dimension of said shaft receiving bore of said body to receive a bearing which engages a part of an upper drive shaft of said upper gearset.

13. The method of claim 12, further comprising the step of inserting said drive shaft into said shaft bore of said body of said support.

14. The method of claim 13, further including the step of installing an upper gearset at the upper end of said drive shaft.

15. The method of claim 1, further comprising the step of machining said shaft receiving bore to allow said step of inserting said body in said shaft receiving bore.

16. The method of claim 15, further comprising the step of machining said upper case to allow said first retainer and said second retainer to correspondingly engage with said upper case.

17. The method of claim 16, further comprising the step of configuring said first retainer as a flange which extends radially outward from said body of said support.

18. The method of claim 17, further comprising the step of configuring said second retainer as a flange which extends radially outward from said body of said support.

19. The method of claim 18, further comprising the step of inserting said drive shaft into said shaft bore of said body of said support.

20. The method of claim 19, further including the step of installing an upper gearset at the upper end of said drive shaft.

* * * * *